US012030700B2

(12) United States Patent
Mangiameli

(10) Patent No.: US 12,030,700 B2
(45) Date of Patent: Jul. 9, 2024

(54) CABLE TIE

(71) Applicant: C.B. SRL COSTRUZIONI BRESCIANINI, Pogliano Milanese (IT)

(72) Inventor: Leonardo Mangiameli, Misinto (IT)

(73) Assignee: C.B. SRL COSTRUZIONI BRESCIANINI, Pogliano Milanese (IT)

( * ) Notice: Subject to any disclaimer, the term of this patent is extended or adjusted under 35 U.S.C. 154(b) by 0 days.

(21) Appl. No.: 17/764,263

(22) PCT Filed: Sep. 21, 2020

(86) PCT No.: PCT/EP2020/076310
§ 371 (c)(1),
(2) Date: Mar. 28, 2022

(87) PCT Pub. No.: WO2021/063724
PCT Pub. Date: Apr. 8, 2021

(65) Prior Publication Data

US 2022/0340341 A1 Oct. 27, 2022

(30) Foreign Application Priority Data

Oct. 1, 2019 (IT) ..... 102019000017600

(51) Int. Cl.
*B65D 63/10* (2006.01)

(52) U.S. Cl.
CPC .... *B65D 63/1063* (2013.01); *B65D 2563/106* (2013.01); *B65D 2563/107* (2013.01)

(58) Field of Classification Search
CPC ..... B65D 63/1063; B65D 2563/106; B65D 2563/107
See application file for complete search history.

(56) References Cited

U.S. PATENT DOCUMENTS 3,206,813 A * 9/1965 Schumm ..... B65D 63/1072 24/16 PB
3,601,527 A * 8/1971 Markham ..... H01B 17/22 174/173

(Continued)

FOREIGN PATENT DOCUMENTS

CN 101809295 A 8/2010
CN 204210913 U 3/2015

(Continued)

OTHER PUBLICATIONS

International Search Report dated Nov. 23, 2020 re: Application No. PCT/EP2020/076310, pp. 1-4, citing: KR 2010 0122164 A, JP S53 30200 U, JP S49 17691 U, EP 1 813 479 A1 and US 2010/0236030 A1.

(Continued)

*Primary Examiner* — Robert Sandy
*Assistant Examiner* — Rowland Do
(74) *Attorney, Agent, or Firm* — CANTOR COLBURN LLP

(57) ABSTRACT

A cable tie having a tie body that is provided with slots which are arranged along an extension thereof that is used for tightening. The slots are arranged transversely with respect to the extension. The body has an elongated shape with a plate element at one end and a traction ring at the other end.

4 Claims, 5 Drawing Sheets

(56) References Cited

U.S. PATENT DOCUMENTS

| | | | | | |
|---|---|---|---|---|---|
| 3,837,047 | A * | 9/1974 | Bunnell | B65D 63/1072 | 24/16 PB |
| 3,991,444 | A * | 11/1976 | Bailey | B65D 63/1063 | 24/16 PB |
| 4,154,418 | A * | 5/1979 | Wiese | B65D 63/1072 | 248/316.1 |
| 4,805,856 | A * | 2/1989 | Nicoli | F16L 3/233 | 292/307 R |
| 5,363,536 | A * | 11/1994 | Kleeman | F16L 3/2336 | 24/30.5 P |
| 6,226,839 | B1 * | 5/2001 | Sayegh | E05B 73/0017 | 70/57.1 |
| 7,540,069 | B2 * | 6/2009 | Okamoto | B65D 63/1063 | 248/692 |
| 8,955,198 | B2 * | 2/2015 | Carnevali | B65D 63/1063 | 24/17 AP |
| 10,479,574 | B2 * | 11/2019 | Vorhis | B65D 63/1081 | |
| 10,670,065 | B2 * | 6/2020 | Daly | F16B 13/0808 | |
| 2007/0033772 | A1 * | 2/2007 | Brownlee | B65D 63/1072 | 24/16 PB |
| 2010/0236030 | A1 | 9/2010 | Dyer | | |
| 2022/0177207 | A1 * | 6/2022 | McDowell, III | B65D 63/1063 | |

FOREIGN PATENT DOCUMENTS

| | | | |
|---|---|---|---|
| CN | 209038206 | U | 6/2019 |
| EP | 1813479 | A1 | 8/2007 |
| JP | S4917691 | U | 2/1974 |
| JP | S5330200 | U | 3/1978 |
| KR | 20100122164 | A | 11/2010 |

OTHER PUBLICATIONS

IT Search report dated Apr. 9, 2020 re: Application No. IT 201900017600, pp. 1-7, citing: KR 2010 0122164 A, JP 85330200 U, JP S49 17691 U, EP 1 813 479 A1 and US 2010/0236030 A1.

Written Opinion dated Nov. 23, 2020 re: Application No. PCT/EP2020/076310, pp. 1-6, citing: KR 2010 0122164 A, EP 1 813 479 A1, JP S53 30200 U and JP S49 17691 U.

Chinese Office Action and Search Report for Chinese Application No. 202080069695.2, dated Feb. 10, 2023, 9 pages.

Brazilian Office Action for Application No. 112022006062-9, dated Nov. 14, 2023, 4 pages.

* cited by examiner

CABLE TIE

TECHNICAL FIELD

The present disclosure relates to a cable tie. More specifically, the disclosure relates to a cable tie of extremely low weight with respect to conventional ties.

BACKGROUND

As is known, cable ties are constituted by an elongated body which is provided with a plurality of teeth which are arranged along the entire extension of the body of the tie, and which engage adapted slots which are defined at a well-delimited region of the tie.

In this manner, the user wraps the tie around a cable to be tied and pulls the tie by acting on a traction element, making the tie slide until the teeth of the body of the tie engage the slots, in so doing fixing the cable.

The above solution, although effective, entails a weight of the tie that is not negligible, and this, for example in the automotive sector, where ties are employed in great numbers, can have an impact on the final weight of the vehicle. Given the extreme need to reduce weight, also with the goal of containing the consumption of fuel, a "heavy" tie is undesirable.

Furthermore, conventional ties, in order to be fastened, require that the body of the tie be made to slide fully through the tightening region, and it is not possible to decide to fasten the tie at an intermediate point of the body.

This fact entails the need both to have enough space to be able to thread the body of the tie and tighten it, which is not always possible in the restricted spaces of an engine compartment, and also it entails a more complicated manual action by the user, who must use one hand to thread the body of the tie and make it slide in its entirety.

Even furthermore, conventional ties need to be cut in order to be reopened. Ties of the type that can be reopened must be reopened using two hands, threading the entire body of the tie along all its length.

SUMMARY

The aim of the present disclosure is to provide a cable tie that has reduced weight compared to conventional ties.

Within this aim, the present disclosure provides a cable tie wherein the insertion of the tie can occur without necessarily having to make the entire body of the tie slide through the tightening region.

The present disclosure also provides a tie that offers rapid disengagement.

The present disclosure further provides a cable tie that has a holding capacity at least equal to that of conventional ties.

The present disclosure provides a cable tie that is highly reliable, easily and practically implemented and of low cost.

This aim and these and other advantages which will become better apparent hereinafter are achieved by providing a cable tie comprising a tie body, which is characterized in that said tie body is provided with a plurality of slots which are arranged along the extension thereof that is used for tightening.

BRIEF DESCRIPTION OF THE DRAWINGS

Further characteristics and advantages of the disclosure will become better apparent from the detailed description of a preferred, but not exclusive, embodiment of the cable tie according to the disclosure, illustrated by way of non-limiting example in the accompanying drawings, wherein.

DETAILED DESCRIPTION OF THE DRAWINGS

Figure 1:
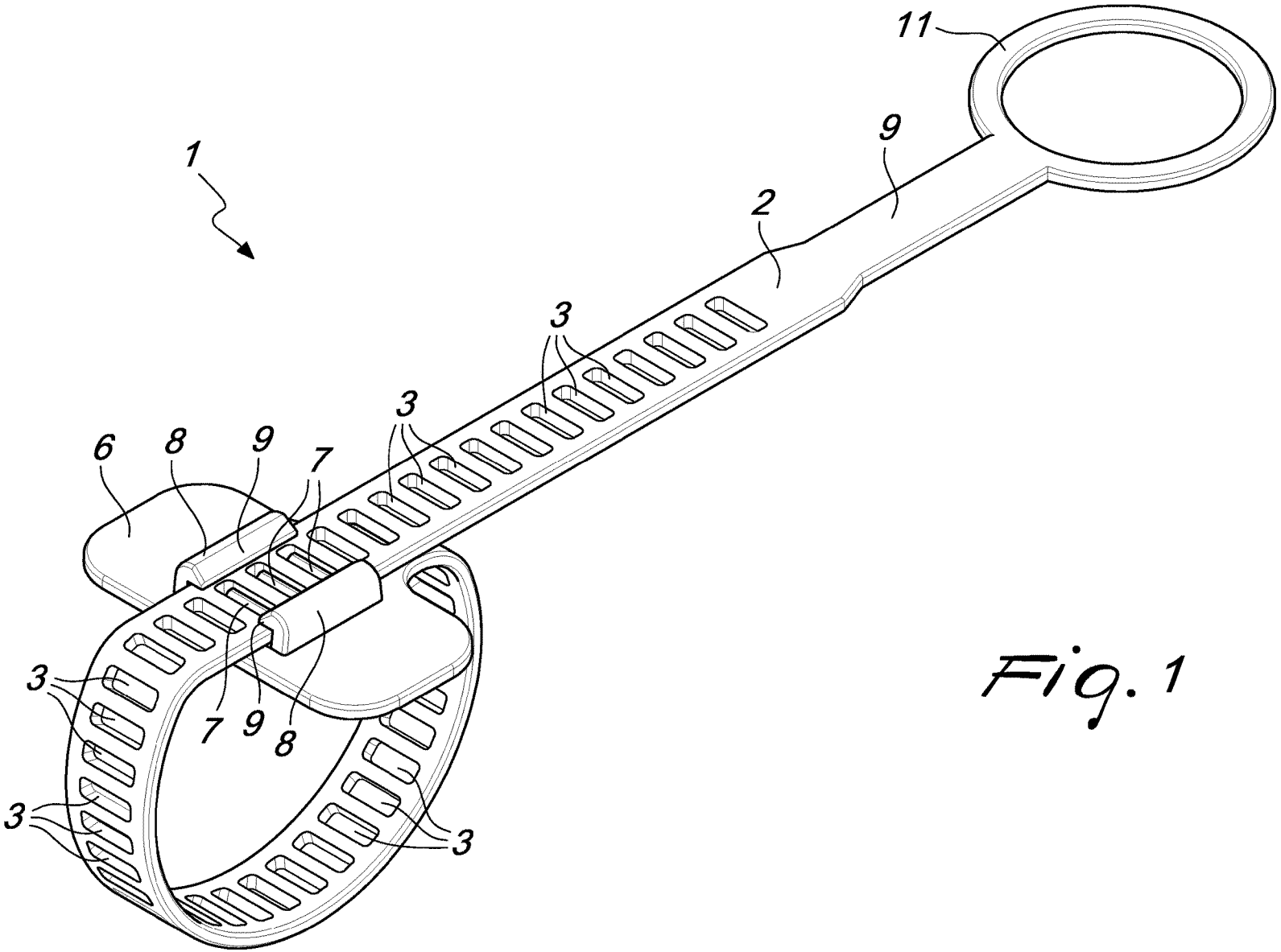
FIG. 1 is a perspective view of a cable tie according to the present disclosure.
Figure 2:
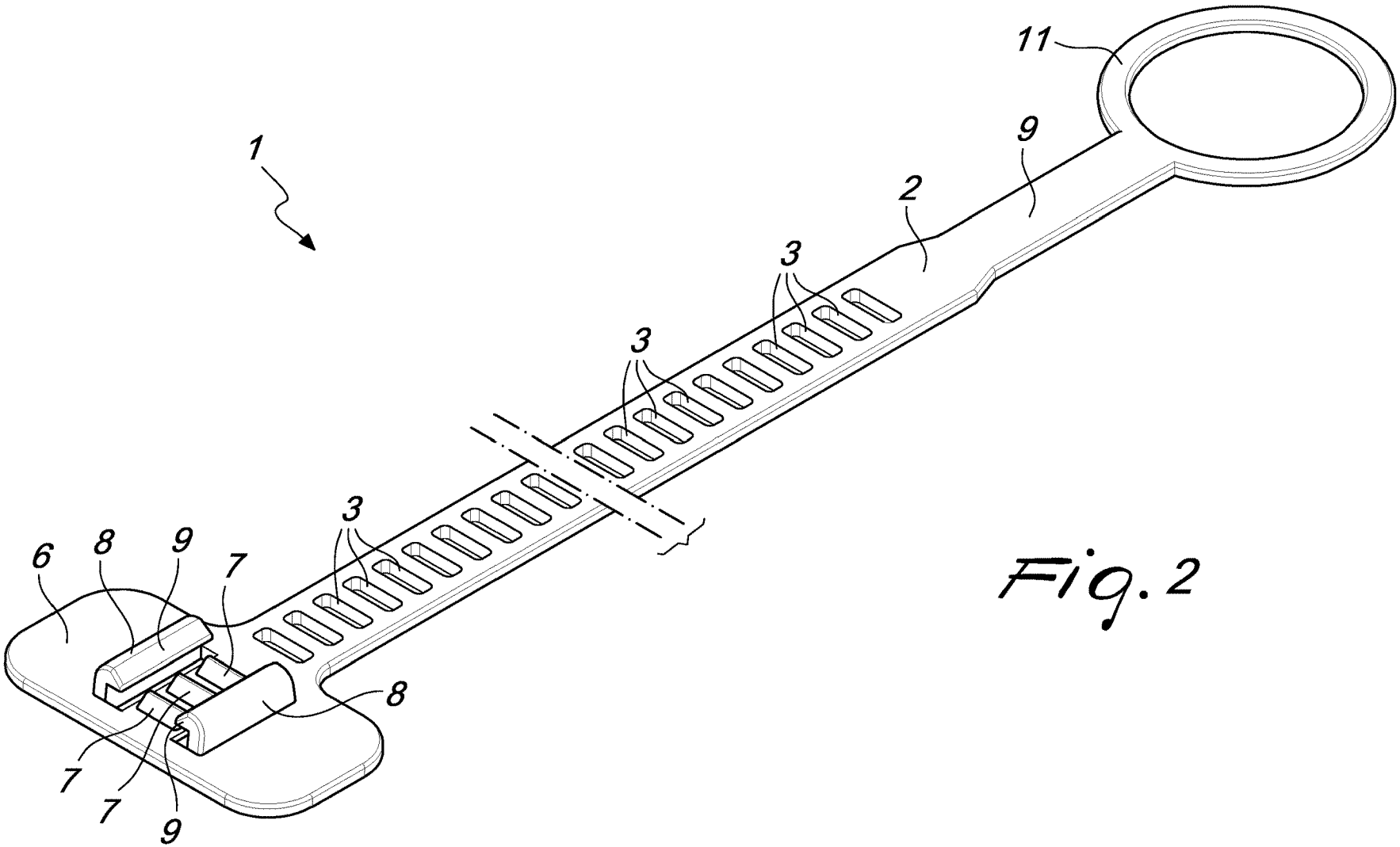
FIG. 2 is a perspective view of the cable tie of FIG. 1 in the open configuration.
Figure 3:
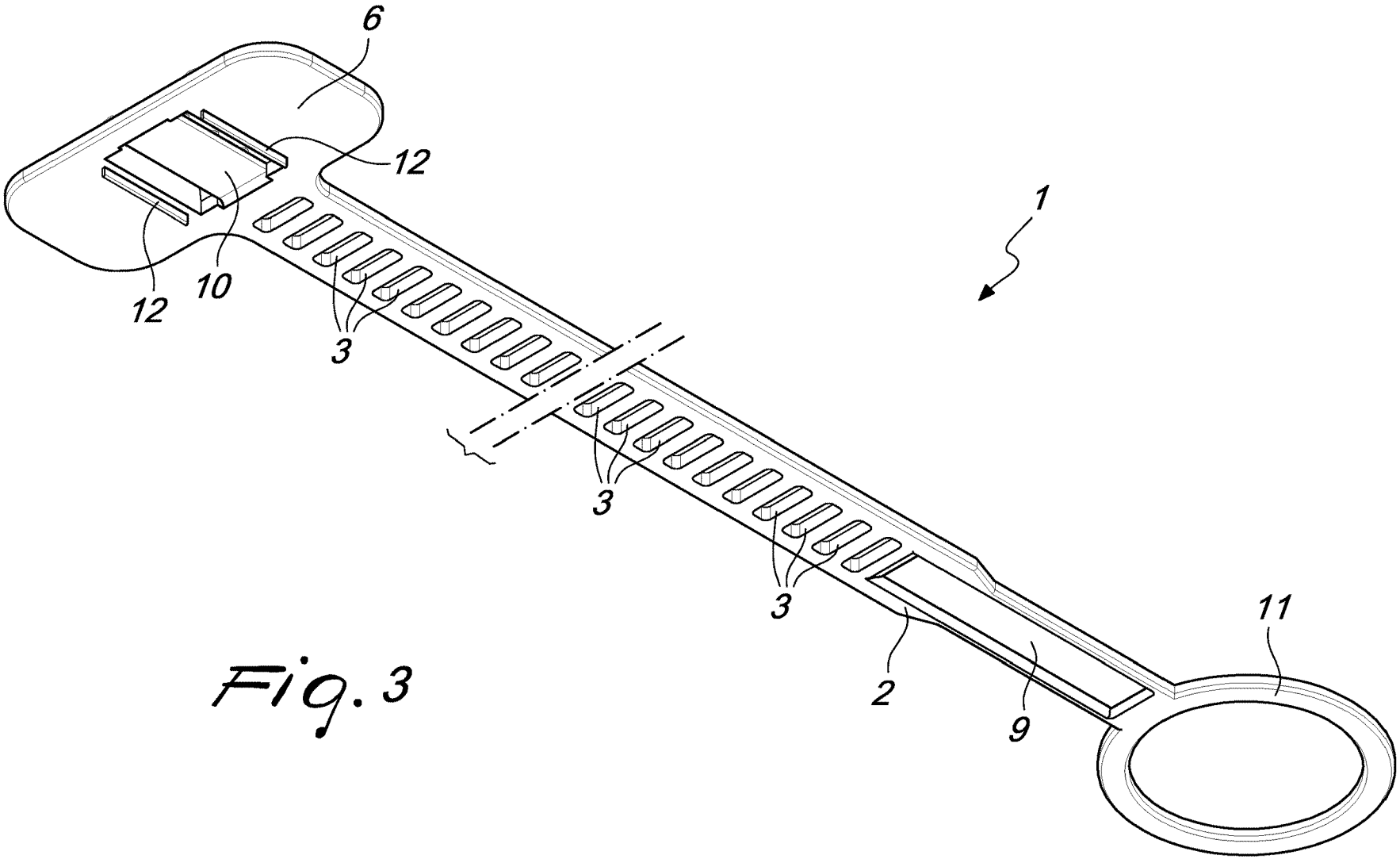
FIG. 3 is a perspective view from below of the cable tie according to the disclosure.

With reference to the figures, the cable tie according to the disclosure, generally designated by the reference numeral 1, comprises an elongated (band-like) tie body 2 which is provided with a plurality of slots 3 which are arranged transversely along the extension of the elongated body 2, substantially along the entire portion of body that is used for tightening.

Figure 4:
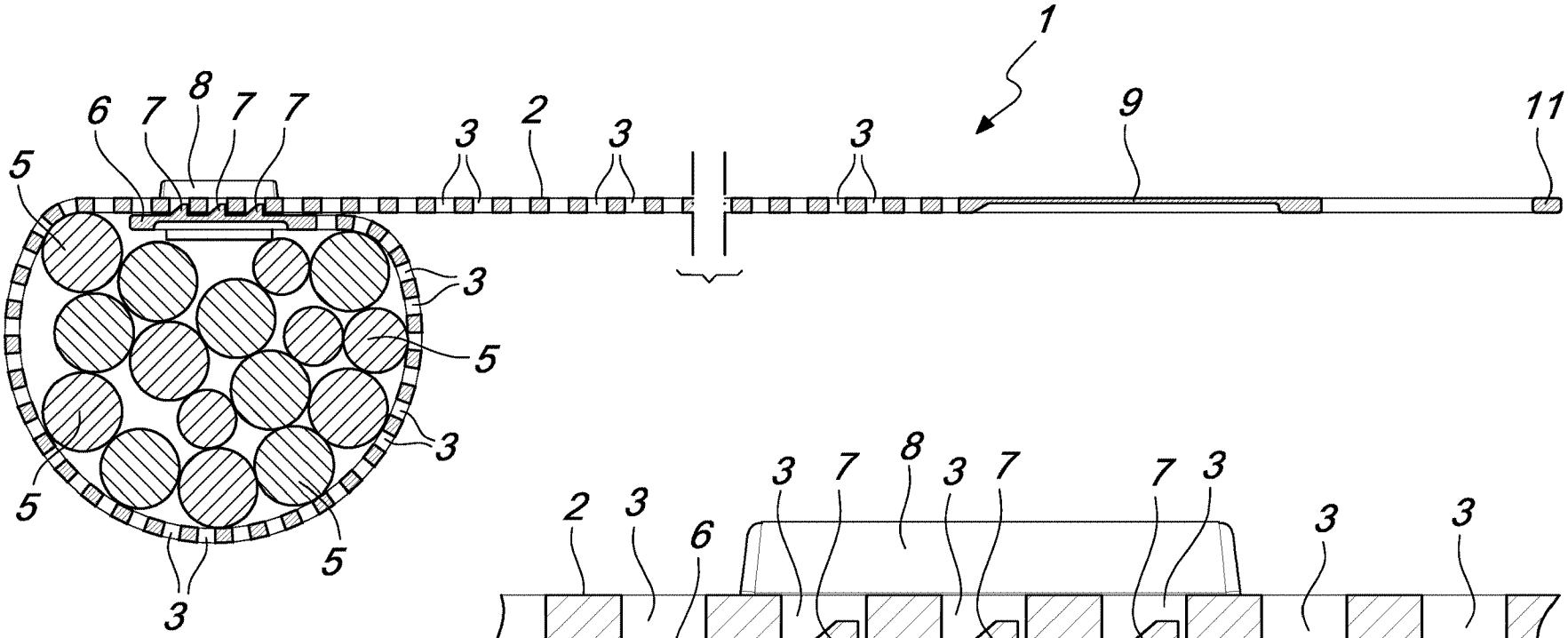
FIG. 4 is a longitudinal cross-sectional view of the cable tie according to the disclosure, in the operating configuration.
Figure 5:
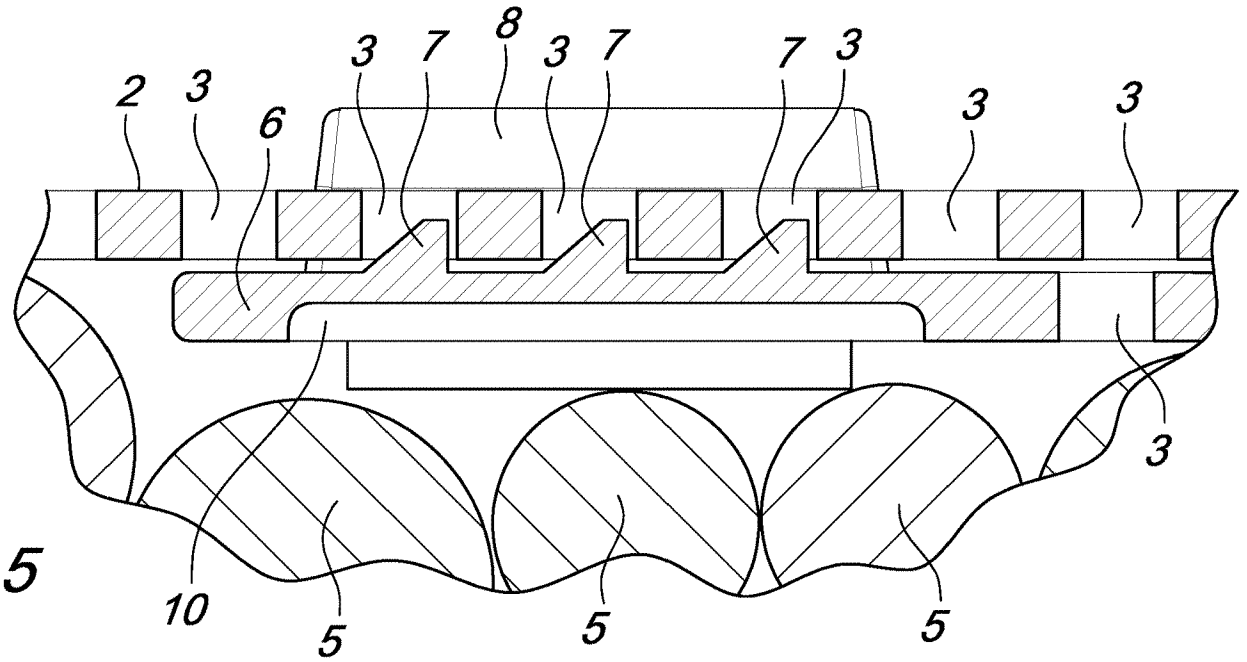
FIG. 5 is a longitudinal cross-sectional view of a detail of FIG. 4.
Figure 6:
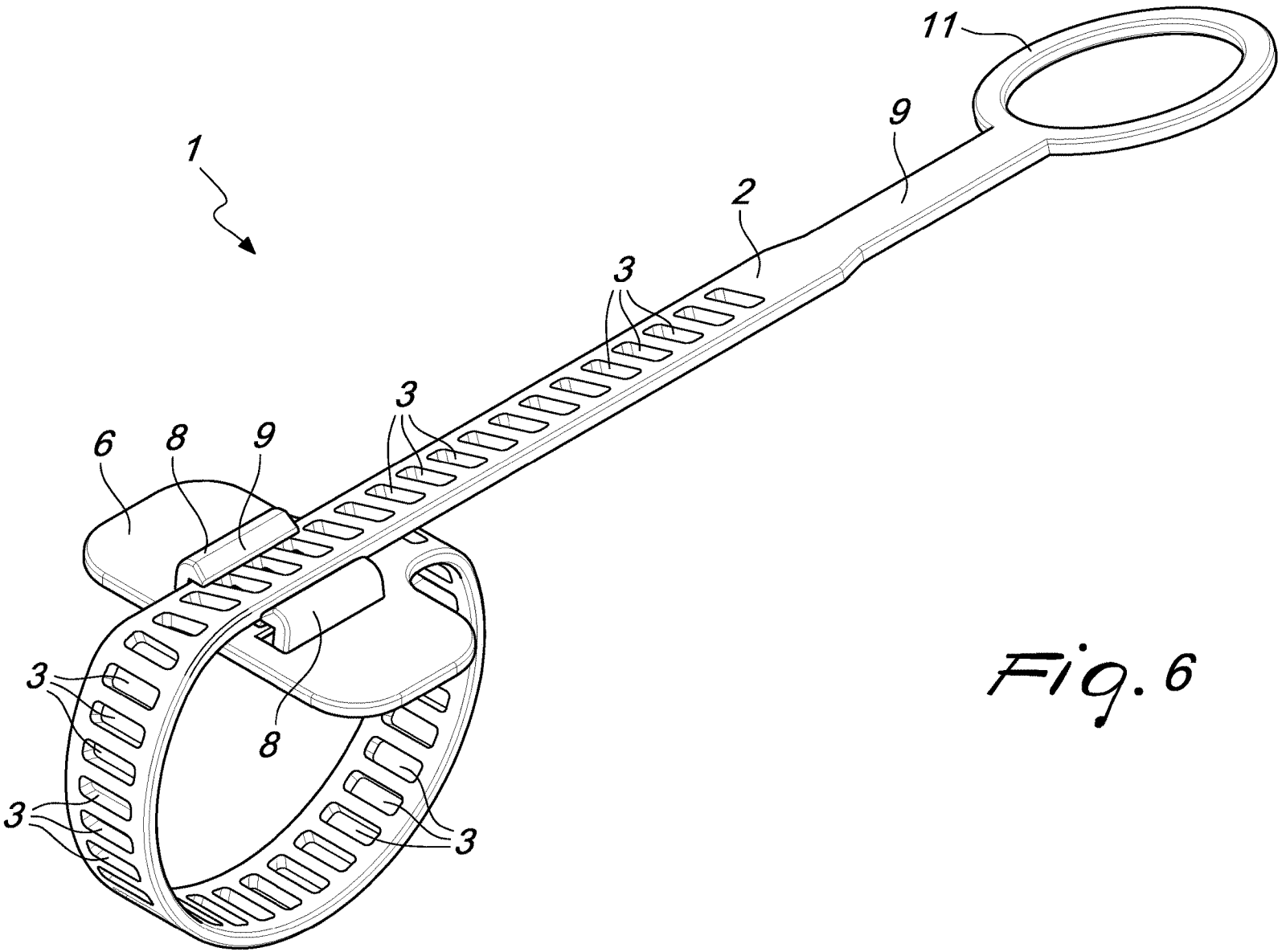
FIG. 6 is a perspective view of the cable tie according to the disclosure in the tightened configuration.

Conveniently, the slots 3 make it possible to considerably reduce the weight of the tie and make it possible at the same time to ensure the coupling and the tightening of the tie around a cable or rather a plurality of conducting cables 5, as shown in FIG. 4.

The tie body 2 is provided at one end with a plate-like element 6 which is provided centrally with a plurality of engagement teeth 7 which are adapted to engage the slots 3 of the tie body 2. The plate-like element 6 is further provided with a pair of retention teeth 8 which allow both the passage of the tie body 2 by translation through them, as happens in a normal tie, taking advantage of the narrowing of the cross-section 9 of the tie body 2 for the insertion between the pair of facing teeth 8, and also allow an insertion of the tie body 2 at any intermediate point thereof. This is due to the presence of inclined planes 9 which are defined at the upper end of the facing teeth 8, which allow the inclined insertion of the tie body 2 and its positioning at the lower end of the teeth 8, adjacent to the plate-like element 6, and with the teeth 7 engaged in the slots 3.

The engagement teeth 7 have a face that is inclined with respect to the surface of the plate-like element and a face that is perpendicular to the surface of the plate-like element.

Conveniently, the plate-like element 6 has a reduced thickness below the engagement teeth 7, i.e. the plate-like element 6 is hollowed out and is provided with a recess 10.

The recess 10 confers flexibility to the plate-like element 6 and allows the tie body 2 to slide between the plate-like element 6 and the retention teeth 8.

In fact, when the user wishes to tighten the tie, whether he or she has inserted the tie body 2 for its entire length through the retention teeth 8, or he or she has inserted it at an intermediate point thereof, as explained previously, the tightening occurs by acting on a ring 11 which is present at the end of the tie body 2 which is opposite to the end where the plate-like element 6 is present.

The ring 11 is then pulled in order to enable the tightening. The action of pulling the ring 11 ensures that the tie body 2 slides over the teeth 7 with the plate-like element 6 flexing and so allowing the tie body 2 to jump from one tooth to the next and therefore to locate the suitable slot 3 for engaging the tooth 7, so as to ensure the required tightening.

Conveniently, the plate-like element 6 is provided in a lower region with at least one pair of raised portions 12 which constitute protrusions from the lower surface of the plate-like element 6 and allow a further tightening action against the conducting cables 5 or corrugated tubes that need to be bound by the tie according to the disclosure.

The tie according to the disclosure allows an extremely rapid opening (reopening), using one hand only and without needing to cut the tie.

In fact, the user can act on the ring 11, with one hand pulling upward, toward the fastening region. The retention teeth 8, being elastic, yield and allow the elongated (band-like) body to exit, thus allowing the tie to be disengaged.

In practice it has been found that the cable tie according to the disclosure makes it possible to have reduced weight with respect to conventional ties and this is an enormous advantage if the tie is used for example in motor vehicles.

Furthermore, the tie can be coupled without threading the tie body completely through the tightening region (plate-like element and retention teeth), but simply by choosing a suitable position for the body of the tie, so as to be able to make the body slide only for a minimum distance in order to execute the tightening.

The tie thus conceived is susceptible of numerous modifications and variations, all of which are within the scope of the appended claims.

Moreover, all the details may be substituted by other, technically equivalent elements.

In practice, the materials used, as well as the contingent shapes and dimensions, may be any according to the requirements and to the state of the art.

The disclosures in Italian Patent Application No. 102019000017600 from which this application claims priority are incorporated herein by reference.

The invention claimed is:

1. A cable tie comprising a tie body, said tie body having an elongated shape and comprising at one end, a plate element and, at an opposite end, a traction ring, a pair of retention teeth being arranged on said plate element, which face each other and are perpendicular with respect to an extension of said plate element, wherein said tie body is provided with a plurality of slots arranged along an extension of the tie body that is used for tightening, and wherein said plate element has a plurality of engagement teeth adapted to engage in said slots of said tie body, said plate element having a lower thickness at said engagement teeth, in order to allow flexibility of said plate element when said tie body is made to slide between said plate element and said retention teeth, said plate element being hollowed out and provided with a recess, wherein said plate element is provided in a lower region with at least one pair of raised portions which constitute protrusions from a lower surface of the plate element and allow a further action to tighten the tie body.

2. The tie according to claim 1, wherein said slots are arranged transversely with respect to the extension of the tie body.

3. The tie according to claim 1, wherein said pair of retention teeth are shaped with an inclined plane at an upper end thereof, in order to allow engagement of said tie body in an intermediate region of the tie body.

4. The tie according to claim 1, wherein said engagement teeth have a face that is inclined with respect to a surface of said plate element and a face that is perpendicular to the surface of said plate element.

* * * * *